US011302223B1

(12) United States Patent
Cibulski

(10) Patent No.: US 11,302,223 B1
(45) Date of Patent: Apr. 12, 2022

(54) TABLE TOP HYDRO-MECHANICAL CANDELABRA DISPLAY DEVICE

(71) Applicant: Anthony A. Cibulski, Birmingham, AL (US)

(72) Inventor: Anthony A. Cibulski, Birmingham, AL (US)

( * ) Notice: Subject to any disclaimer, the term of this patent is extended or adjusted under 35 U.S.C. 154(b) by 0 days.

(21) Appl. No.: 17/089,679

(22) Filed: Nov. 4, 2020

(51) Int. Cl.

| | |
|---|---|
| ***G09F 19/00*** | (2006.01) |
| ***G09F 19/12*** | (2006.01) |
| ***F21S 10/00*** | (2006.01) |
| *F21Y 115/10* | (2016.01) |

(52) U.S. Cl.
CPC ..... *G09F 19/12* (2013.01); *F21S 10/002* (2013.01); *F21S 10/007* (2013.01); *F21Y 2115/10* (2016.08)

(58) Field of Classification Search
CPC ..... G09F 19/12; G09F 19/02; F21S 10/002; F21S 10/007; F21S 10/06; F21Y 2115/10; B05B 17/00; B05B 17/08; A61N 5/0618; A47B 2220/0077; F21W 2121/02; F21W 2131/301; F21V 33/008; F21V 9/12; F21V 9/08; F21V 9/083; B44C 5/06; B67D 1/0004; B67D 1/08; B67D 1/0875; B67D 1/10; B67D 1/165; A61M 21/02
See application file for complete search history.

(56) References Cited

U.S. PATENT DOCUMENTS

| | | | | |
|---|---|---|---|---|
| 6,416,197 | B1 * | 7/2002 | Chang | F21S 10/002 362/96 |
| 6,447,137 | B1 * | 9/2002 | Long | B05B 17/085 239/17 |
| 10,149,959 | B1 | 12/2018 | Cibulski | |
| 2015/0083819 | A1 * | 3/2015 | Cibulski | F21S 10/002 239/17 |

* cited by examiner

*Primary Examiner* — Omar Rojas Cadima
(74) *Attorney, Agent, or Firm* — Shifrin Patent Law; Dan Shifrin

(57) ABSTRACT

A table top hydro-mechanical candelabra display device is provided that combines in one small package the comforting light of a candle, the tranquil sounds of a waterfall, and the mood elevating splash of vibrant colors, to name a few. The display device includes a transparent reservoir for containing liquid; a plurality of lights disposed below a bottom portion of the reservoir; a pump inside the reservoir; a first pressure chamber fed by the pump; a rotating candelabra; and a waterfall creating cavitation bubbles to camouflage the unsightly hardware. The device may also include a second pressure chamber. Liquid is pumped from the reservoir into the first pressure chamber flows through openings back into the reservoir and into the second pressure chamber, from which it also flows into the reservoir. The force of the flowing liquid causes the candelabra to rotate and creates the bubbles.

5 Claims, 6 Drawing Sheets

TABLE TOP HYDRO-MECHANICAL CANDELABRA DISPLAY DEVICE

TECHNICAL FIELD OF THE INVENTION

The present invention relates to table top water features and, more particularly, to an illuminated ornament having various water effects.

BACKGROUND OF THE INVENTION

In an era of extreme stress and insane chaos, the demand for anxiolytics, anti-depressants and insomniolytics has increased at an alarming rate. Therefore, there have been efforts made in the development of non-pharmaceutical strife-liberating approaches to conquer these personal burdens. Water displays have been developed for providing a serene and relaxing visual and audial effect for the user.

Conventional water displays, such as those designed for a desk or table top, often lack illumination and provide just a single water pattern.

As can be seen, there is a need for an improved table or desk top water display ornament that has the ability to provide multiple visual and audial effects for the user.

SUMMARY OF THE INVENTION

The present invention provides a table top hydro-mechanical candelabra display device that combines in one small package many of the comforts we experience in life: the comforting light of a candle, the tranquil sounds of a waterfall and the mood elevating splash of vibrant colors, to name a few. The display device comprises a transparent reservoir for containing water; a plurality of lights disposed below a bottom portion of the reservoir; a pump disposed inside the reservoir; a pressure chamber fed by the pump via a pump to pressure chamber tube; a rotating candelabra; and a waterfall creating cavitation bubbles to camouflage the unsightly hardware. The cavitation bubbles are illuminated by multicolored light emitting diodes.

DETAILED DESCRIPTION OF THE EMBODIMENTS

Figure 1:
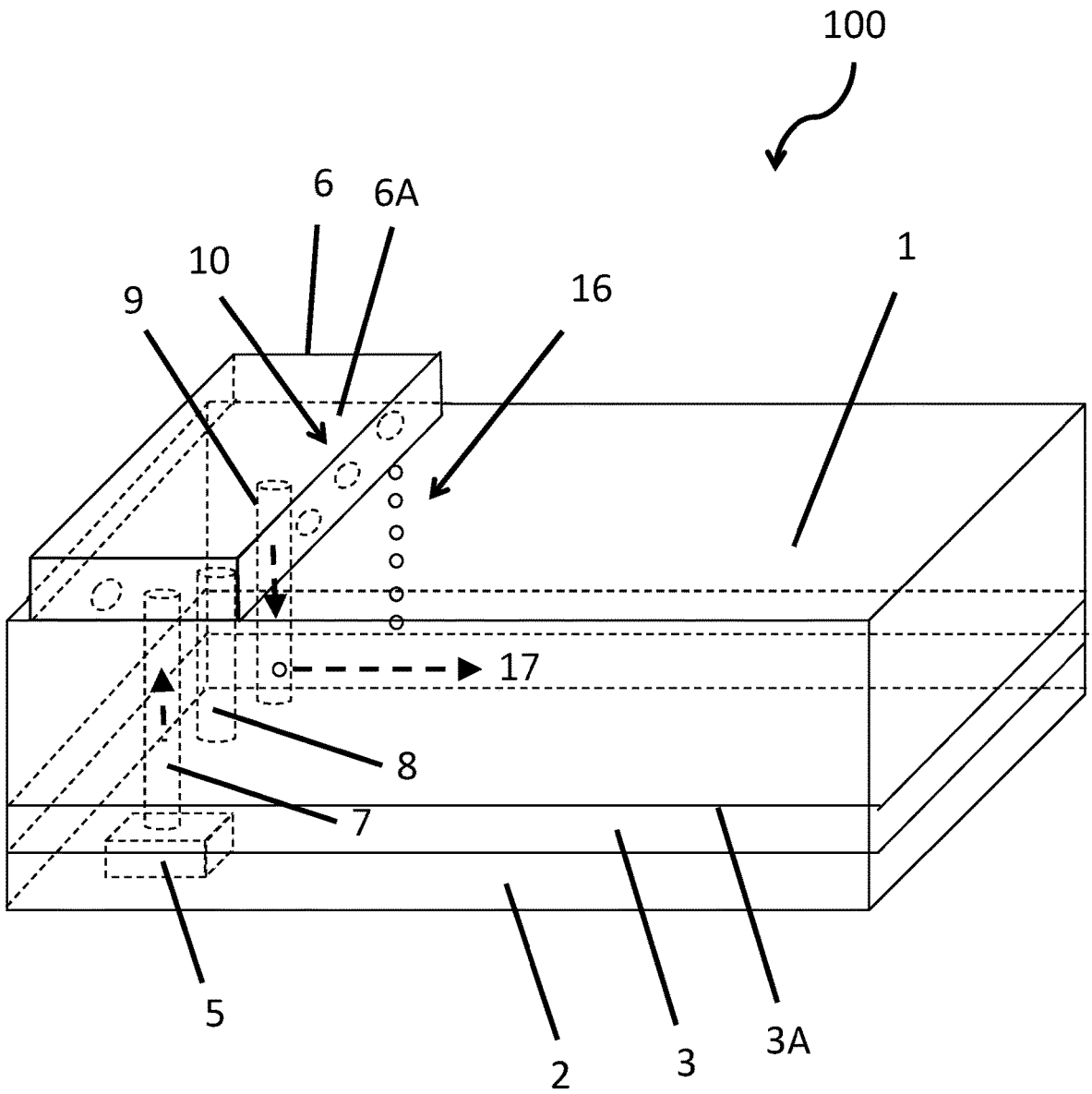
FIG. 1 is a perspective view of an embodiment of a hydro-mechanical candelabra display ("HCD") device of the present invention.

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Embodiments of the present invention include a hydro-mechanical candelabra display ("HCD") having a reservoir; a pump; upper and lower pressure chambers; rotating disks reflecting colorful lights; and a rotating candelabra. The following list identifies the components illustrated in the Figures. Not all embodiments may have all of the listed components and some embodiments may have additional components.

Figure 5:
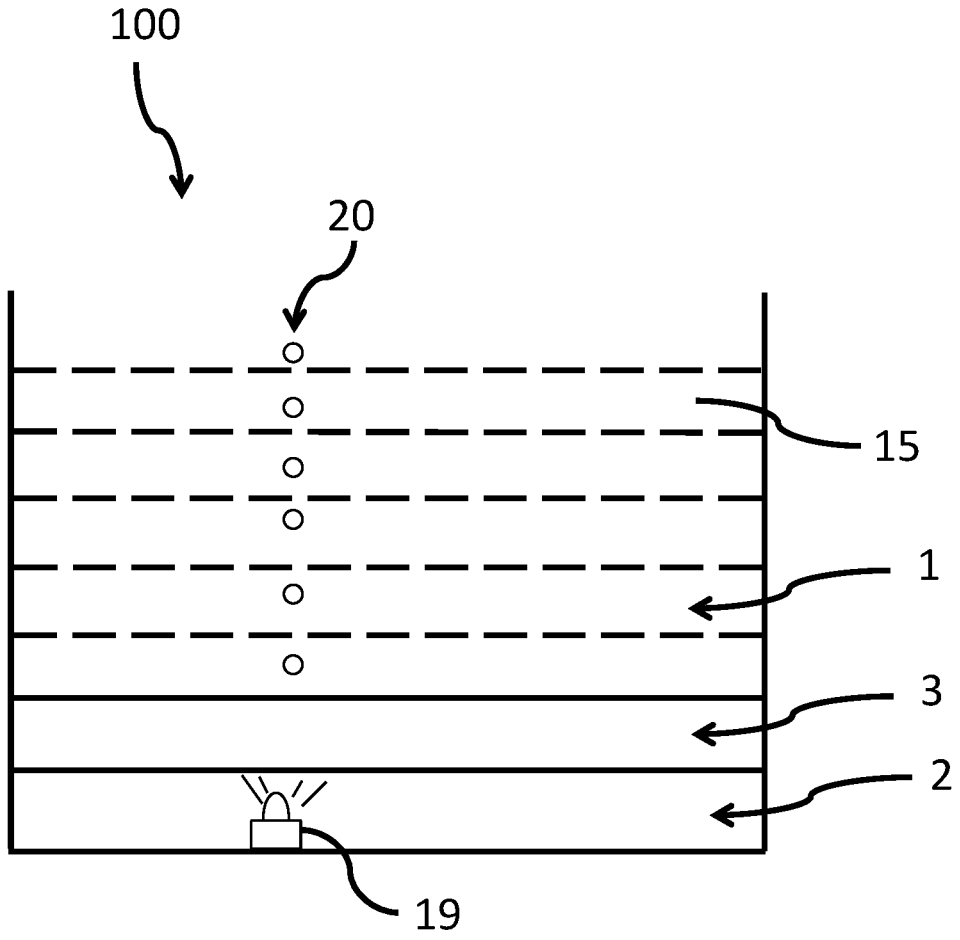
FIG. 5 illustrates a heat generated bubble geyser and its underlying light emitting diode in the HCD of FIG. 1.

1. Watertight reservoir;
1A. Top surface of the reservoir 1;
1B. Bottom surface of the reservoir 1;
2. LED compartment beneath the lower pressure chamber 3;
3. Lower pressure chamber;
3A. Upper panel of the lower pressure chamber 3;
4. Not used;
5. Pump;
6. Upper pressure chamber;
6A. Bottom panel of the upper pressure chamber 6;
7. Pump tube that feeds the upper pressure chamber 6;
7A. Pump tube opening in the bottom panel 6A of the upper pressure chamber 6;
7B. Pump tube opening in top surface 1A of the reservoir 1;
8. Upper pressure tube that feeds the lower pressure chamber 3;
8A. Upper pressure tube opening in the bottom panel 6A of the upper pressure chamber 6;
8B. Upper pressure tube opening in the top surface 1A of reservoir 1;
8C. Upper pressure tube opening in the bottom surface 1B of the reservoir 1;
8D. Upper pressure tube opening in the top surface 3A of the lower pressure chamber 3;
9. A second upper pressure chamber tube that feeds a lateral jet 17 to the reservoir 1;
9A. Upper pressure tube opening in the bottom panel 6A of the upper pressure chamber 6;
9B. Upper pressure tube opening in the top surface 1A of the reservoir 1;
10A. Array of portals in the bottom panel 6A of the upper pressure chamber 6;
10B. Array of portals in the top surface 1A of the reservoir 1;
11. Oblique jet through an oblique portal in the upper panel 3A of the lower pressure chamber 3;
12. Disk on floor of the reservoir 1;
13. Portal in the upper panel 3A of the lower pressure chamber 3;
14. Water geyser propelled from the lower pressure chamber 3 through the portal 13;
15. Water or other liquid in the reservoir 1;
16. Cavitation bubbles formed by the downward flow from the upper pressure chamber 6 through the array of portals 10;
17. Lateral jet propelled into the reservoir 1 from a portal 23 in the tube 9 fed by the upper pressure chamber 6;
18. Candelabra disk;
19. Light emitting diode(s) in the compartment 2;
20. Bubble geyser in the reservoir water 15 generated by the underlying light emitting diode 19;
21. Acrylic plates of a lotus blossom;
22. Oil lamp sphere;
23. Portal in the upper pressure chamber tube 9;

24. Oil lamp wick;

25. Oil lamp flame;

26. Not used;

27. Oblique portal in the upper panel 3A of the lower pressure chamber 3;

28. Vanes on the undersurface of the candelabra disk 18 and the reservoir floor disk 12, as shown in FIG. 5;

29. Dome-shape cap center for the candelabra disk 18 and the disk 12, as shown in FIG. 5;

30. Acrylic axle for the candelabra disks 18 and 12, as shown in FIG. 5.

FIG. 1 illustrates a perspective view of an embodiment of an HCD 100 of the present invention. As shown in FIG. 1, the device 100 includes a reservoir 1 for holding a liquid 15, such as water. The reservoir 1 may be any size or shape, be made of suitable water-tight material including, but not limited to, glass or plastic, and be transparent, opaque, and in any or no color. Disposed within the reservoir 1 is at least one pump 5 for pumping the liquid 15 throughout the device 100. Suitable pumps include, but are not limited, a Becket 2.2 amp pump and the like.

Figure 2A:
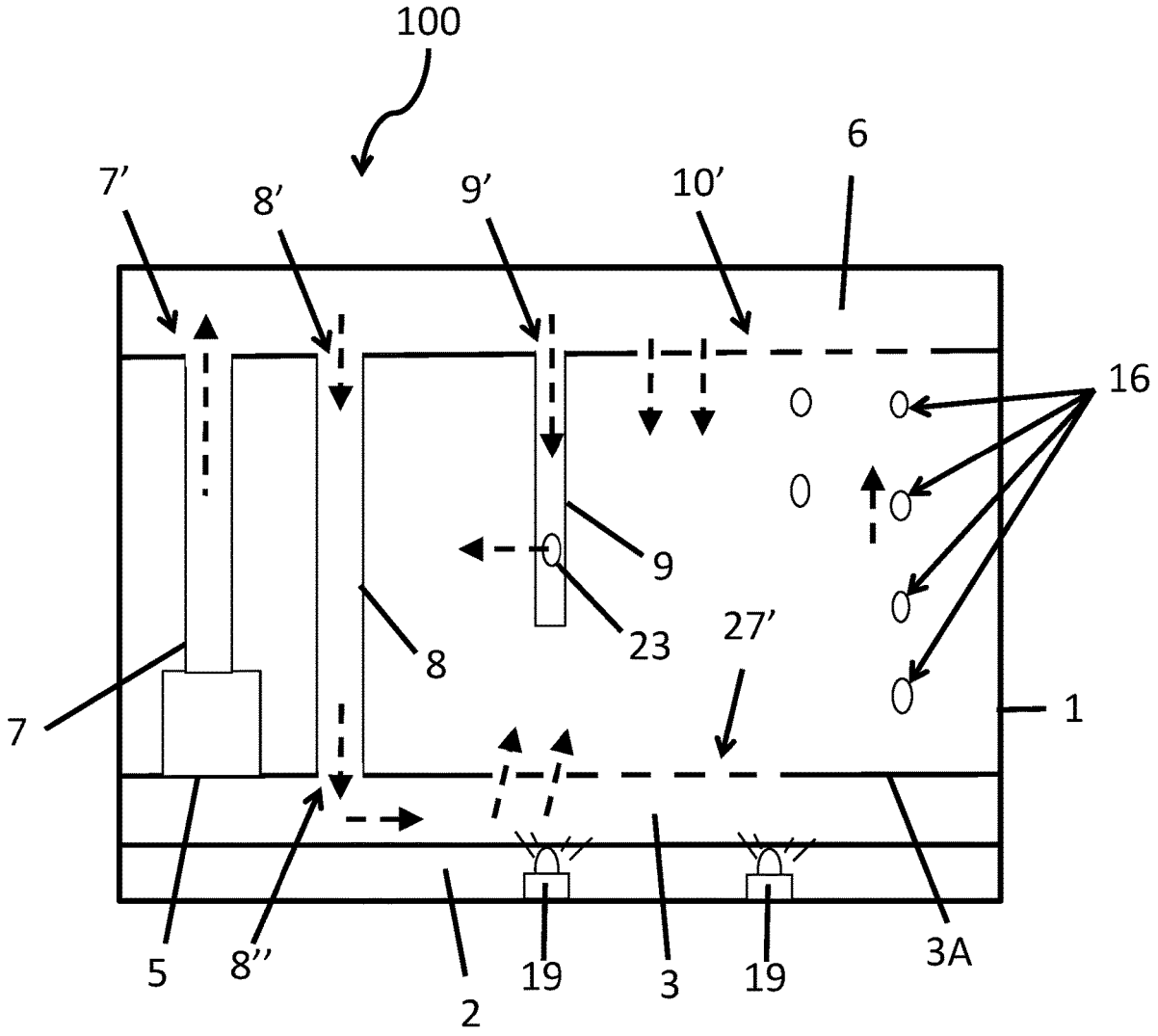
FIG. 2A is a front view of the HCD of FIG. 1.
Figure 2B:
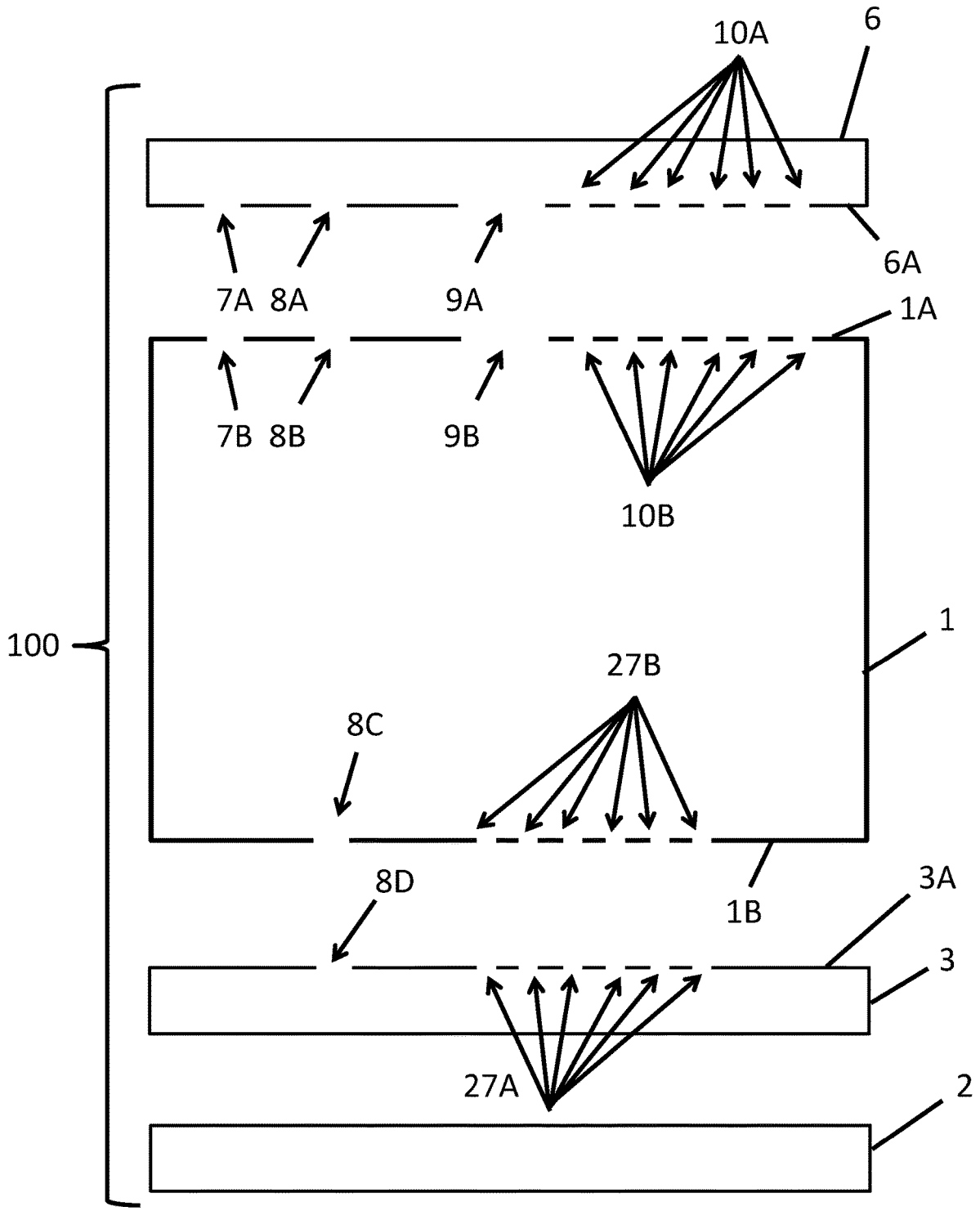
FIG. 2B is an exploded front view of the HCD of FIG. 1.

The pump 5 propels the liquid 15 from the reservoir 1 through a pressure chamber tube 7 and openings 7A, 7B (collectively 7') in upper and lower surfaces 1A, 6A of the reservoir 1 and an upper pressure chamber 6, respectively, to the upper pressure chamber 6 disposed at the top surface 1A of the reservoir 1. In the FIGs., the flow of liquid is represented by dashed arrows, such as arrow 17 in FIG. 1. The upper pressure chamber 6 may include an array of openings or portals 10A in the bottom panel 6A. Similarly, the reservoir 1 may include a corresponding array of openings or portals 10B in the upper surface 1A. The portals 10A, 10B (collectively 10') allow the liquid 15 present in the upper chamber 6 to flow back into reservoir 1 while providing a curtain of cavitation bubbles 16 in the liquid 15 within the reservoir 1. As shown in the side view of the device 100 (FIG. 2), the device 100 may optionally include a panel of multicolored light emitting diodes (LEDs) 19 beneath the reservoir 1. The LEDs 19 brilliantly illuminate the curtain of cavitation bubbles 16, which help conceal the reservoir hardware, such as the pump 5, the tube 7, and the tubes 8 and 9 (described below). Using the curtain of multicolored cavitation bubbles 16 to conceal the reservoir hardware offers a significant contribution of appearance and a waterfall like sound to the aesthetics of the display.

The upper pressure chamber 6 provides liquid flow to a pressure chamber tube 8 through openings 8A, 8B (collectively 8') in the lower and upper surfaces 6A, 1A of the upper pressure chamber 6 and reservoir 1, respectively, and into the lower pressure chamber 3 through openings 8C, 8C (collectively 8") in the lower and upper surfaces 1B, 3A of the reservoir 1 and lower pressure chamber 3, respectively.

The upper pressure chamber 6 also provides liquid flow to another pressure chamber tube 9 through openings 9A, 9B (collectively 9') in the lower and upper surfaces 6A, 1A of the upper pressure chamber 6 and reservoir 1, respectively. The flow propels a lateral jet 17 of the liquid 15 through a portal 23 positioned in the lower portion of the tube 9. The tube 9 can be rotated and to direct the lateral jet 17 to vanes 28 on the undersurface of a candelabra-like disk 18 (FIGS. 3, 4A) to generate rotation of the disk 18. The lateral jet 17 also creates delightful swirls and undulations in the liquid 15 in the reservoir 1 and circulates intact cavitation bubbles 16 throughout the reservoir. Any intact cavitation bubbles 16 follow the swirls of reservoir liquid 15 and are displayed by the colorful reflections from the laser-like LEDs 19 positioned in the lower chamber 2.

Optionally mounted on the rotating disk 18 may be an artfully crafted arrangement of triangular acrylic plates 21. In the embodiment illustrated in FIG. 3, the arrangement is in the form of a lotus blossom, although other arrangements may be made as well. The arrangement of plates 21 serves as a cradle for a glass sphere 22, which contains lamp oil and a wick 24, and extends above the surface of the liquid in the reservoir 1. The lamp oil may be clear or colored with dye and be scented or unscented. The spherical oil lamp 22 with its lit flame 25 rotates with the acrylic lotus blossom cradle 21. The shape of the oil lamp is not limited to a sphere but may be formed in any other shape including, for example, tear shaped. Additionally, multiple oil containers may be arranged as a complex arbor of, for example, blossoms, depending upon the size of the device.

Figure 4A:
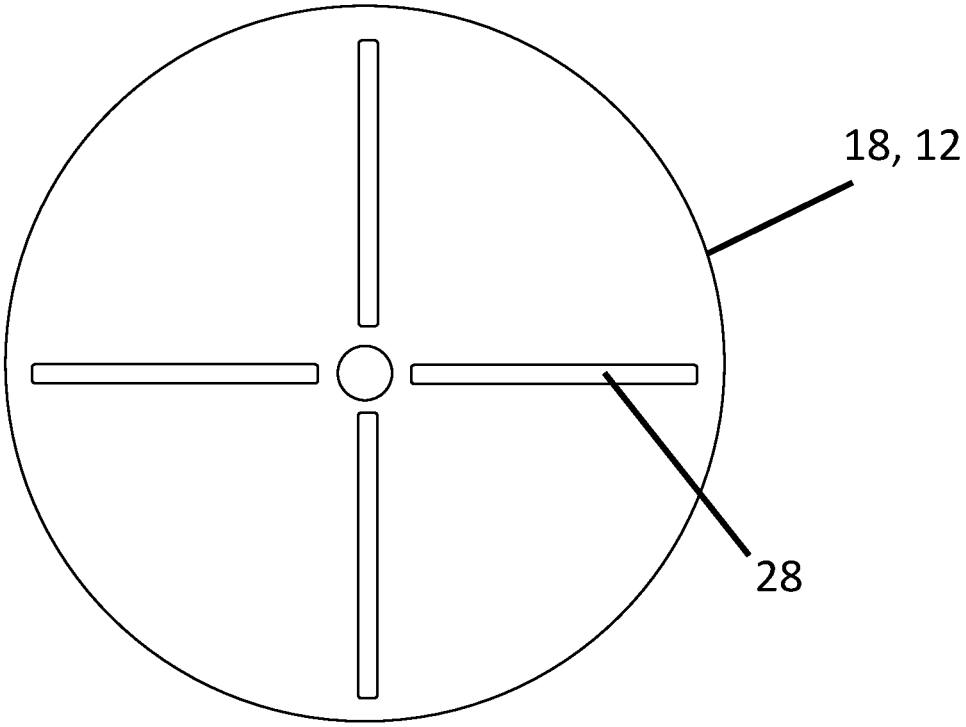
FIG. 4A is a top view of an acrylic disk usable with the HCD of FIG. 1.
Figure 4B:
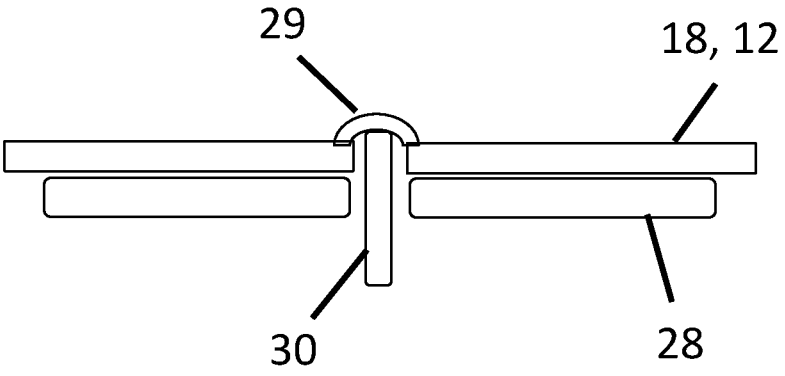
FIG. 4B is a side view of the acrylic disk of FIG. 4A.

The construction of the acrylic disk 18 is illustrated in FIGS. 4A and 4B and is similar to the construction of the disks 12 described below. The center point of rotation of the disks 18 and 12 is obtained with a smooth dome-shaped cap 29 secured to the upper surface of the disks with any appropriate waterproof bond. The lower end of an acrylic axle 30 is secured to the upper panel 3A of the lower pressure chamber 3; the bottom of the disk 18 is secured to the upper end of the axle 30.

Oblique portals 27A are positioned in the front and back portion of the upper panel 3A of the lower pressure chamber 3. Similarly, the reservoir 1 may include corresponding portals 27B in the lower surface 1B (the portals 27A, 27B are collectively referred to as 27'). The lower pressure chamber 3 propels oblique liquid jets through the portals 27' into the reservoir 1 to the undersurface of the disks 12, resulting in the disks' rotation. A visual sparkling effect is transmitted from the rotating disks 12 when the disks' vanes rotate through the array of colored beams of light generated by the LEDs 19.

Figure 3:
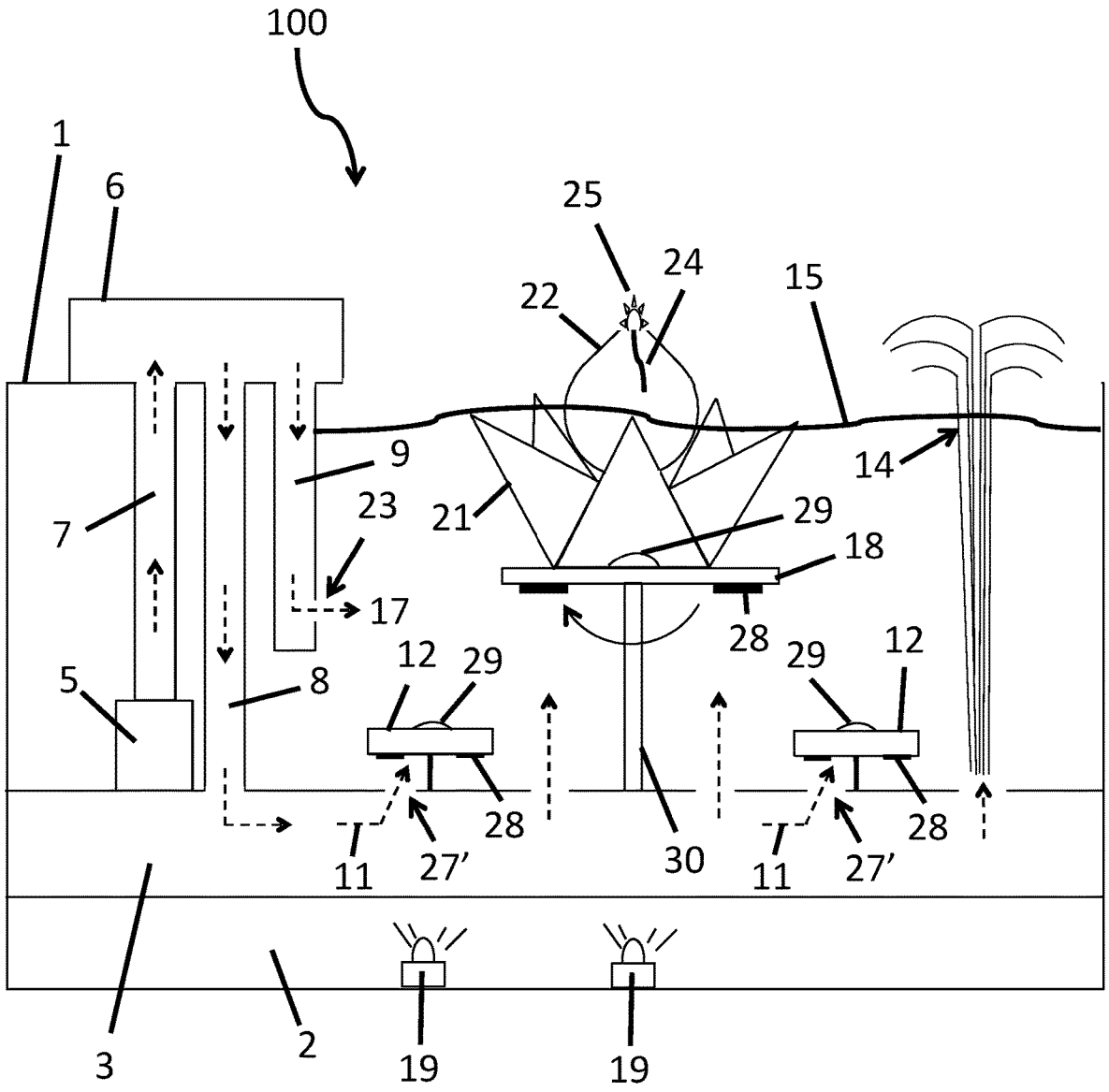
FIG. 3 is a view of the HCD of FIG. 1 through a clear side.

FIG. 3 illustrates a water geyser 14 that is propelled from the lower pressure chamber 3 through a portal 13 in the lower and upper panels 1B, 3A and into the reservoir 1. The water geyser 14 offers significant visual and audible features to the display.

FIG. 5 illustrates a heat generated bubble geyser 20 in the reservoir 1 generated by an underlying LED 19 in the compartment 2. These fascinating colorful eye catching bubble geysers 20 have the potential to be a stand-alone feature in the display.

It will be appreciated that the bottom panel 6A of the upper pressure chamber 6 may consist of a portion of the upper surface 1A of the reservoir 1 instead of being a separate panel. Similarly, the upper panel 3A of the lower pressure chamber 3 may consist of the bottom surface 1B of the reservoir 1 instead of being the two being separate panels. Any of the surfaces, including sidewalls, of the reservoir, upper pressure chamber, and lower pressure chamber may be clear, frosted, or tinted.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A table top hydro-mechanical candelabra display device, comprising:

an enclosed reservoir having top and bottom surfaces, the top surface having first, second, and third openings and a first plurality of openings and the bottom surface having a fourth opening and a second plurality of openings;

a pump within the reservoir;

an enclosed upper pressure chamber having a bottom panel secured to a portion of the top surface of the reservoir, the bottom panel having fifth, sixth, and seventh openings aligned with the first, second, and third openings, respectively, of the reservoir and a third plurality of openings corresponding to and aligned with the first plurality of openings of the reservoir;

an enclosed lower pressure chamber having an upper panel secured to the bottom surface of the reservoir, the upper panel having an eighth opening aligned with the fourth opening of the reservoir and a fourth plurality of openings corresponding to and aligned with the second plurality of openings of the reservoir;

an enclosed base secured to a bottom of the lower pressure chamber;

at least one LED within the base;

a first tube coupled between an outlet of the pump and the aligned first and fifth openings whereby liquid in the reservoir is pumped into the upper pressure chamber;

a second tube having an open upper end coupled to the aligned second and sixth openings and an open lower end coupled to the aligned fourth and eighth openings; and a third tube having an open upper end coupled to the aligned third and seventh openings and a closed lower end in the reservoir, the third tube having at least one side opening whereby liquid from the upper pressure chamber flows laterally into the reservoir;

whereby when the liquid is pumped through the first tube into the upper pressure chamber:

the liquid flows from the upper pressure chamber into the lower pressure chamber through the second tube;

the liquid flows from the lower pressure chamber into the reservoir through the fourth and second plurality of openings the liquid flows from the upper pressure chamber into the reservoir through the at least one side opening in the third tube; and the liquid flows from the upper pressure chamber into the reservoir through the third and first plurality of openings.

2. The table top hydro-mechanical candelabra display device of claim 1, further comprising:

a first vertical axle in the reservoir secured at a lower end to the upper panel of the lower pressure chamber above the second and fourth pluralities of openings;

a first rotatable disk secured to an upper end of the axle; and a plurality of vanes secured to an underside of the rotatable disk and configured to cause the rotatable disk to rotate when liquid flows through the at least one side opening in the third tube.

3. The table top hydro-mechanical candelabra display device of claim 2, further comprising a plurality of decorative plates secured to an upper surface of the rotatable disk.

4. The table top hydro-mechanical candelabra display device of claim 3, wherein the plurality of decorative plates are arranged in the form of a flower.

5. The table top hydro-mechanical candelabra display device of claim 3, further comprising a clear container secured to the plurality of plates, the container extending above the surface of the liquid in the reservoir and configured to contain lamp oil and a wick.

* * * * *